United States Patent [19]

Mayer et al.

[11] 4,251,734

[45] Feb. 17, 1981

[54] PUBLICATIONS COVER WITH DISPLAY DEVICE

[75] Inventors: Carl P. Mayer, Lincoln, R.I.; Robert A. Rothenberg, Lexington, Mass.

[73] Assignee: Chomerics, Inc., Woburn, Mass.

[21] Appl. No.: 36,247

[22] Filed: May 4, 1979

[51] Int. Cl.[3] ..... H01H 9/26

[52] U.S. Cl. ..... 290/5

[58] Field of Search ..... 200/5 A, 159 B, 292, 200/308–317

[56] References Cited

U.S. PATENT DOCUMENTS

| | | | |
|---|---|---|---|
| 3,860,771 | 1/1975 | Lynn et al. | 200/5 A |
| 4,028,509 | 6/1977 | Zurcher | 200/5 A |
| 4,066,851 | 1/1978 | White et al. | 200/5 A |
| 4,090,045 | 5/1978 | Marsh | 200/5 A |
| 4,096,577 | 6/1978 | Ferber et al. | 364/712 |
| 4,145,584 | 3/1979 | Otterlei | 200/5 A |

*Primary Examiner*—Gene Z. Rubinson
*Assistant Examiner*—D. L. Rebsch
*Attorney, Agent, or Firm*—Sewall P. Bronstein; Robert T. Gammons; Donald Brown

[57] ABSTRACT

A report cover with a display device comprising at least two sheets hingedly connected for folding as an inside cover and a third sheet hingedly connected to one of said aforementioned sheets and acting as the bottom cover, said first two mentioned sheets when folded having substantially coextensive confronting surfaces, printed circuits on the confronting surfaces embodying contact areas engageable by pressing the sheets together to complete a current path in the circuitry, cell means on the confronting face of the one sheet, terminal means on the confronting face of the other sheet, the poles of said cell means being engageable with said terminal means by pressing the sheets together to insert a source of current in the circuitry, a light emitting diode connected in the circuitry adapted to be energized by completion of a current path by pressing a pair of confronting contact areas together, means on the outer face of the one sheet indicative of the location poles and the contact areas at the inner side of the sheet to enable pressing the poles into engagement with the terminals to supply the circuitry with an energy source and to press a pair of contact areas together to illuminate the diode and a non-conductive barrier sheet connection to one of the sheets for disposition between the sheets, said barrier sheet containing openings corresponding in position to the pairs of confronting contact areas, poles and terminals.

1 Claim, 6 Drawing Figures

PUBLICATIONS COVER WITH DISPLAY DEVICE

SUMMARY OF THE INVENTION

A publications cover with a display device graphically illustrated thereon and comprising at least two sheets of flexible material hingedly connected for folding, and forming an inside cover and another sheet coupled to one of said first sheets and forming a rear cover, said first two sheets, when folded, having substantially coextensive confronting surfaces, printed circuits on the confronting surfaces embodying contact areas so arranged that they can be pressed together in pairs, cell means on the interface of one of the sheets, terminal means on the interface of the other sheet, said terminal means being engageable by pressing the sheets together to connect the cell means into the circuit, a light emitting diode in the circuit adapted to be energized by completion of the circuit, means on the outer surface of the one sheet indicative of the location of the contact cell means and the areas at the inner side of the sheet to enable pressing the poles into engagement with the terminals and a pair of confronting contact areas together and a non-conductive barrier sheet connected to one of the sheets for disposition between the sheets, said barrier sheet containing openings corresponding in position to the poles and to the contact areas. The cell means comprise two cells disposed with their opposed poles at one end connected and with their opposed poles at their other ends positioned to engage the terminals on the other sheet when the sheets are folded into confronting relation. The non-conductive barrier sheet is a transparent sheet material such as polyethylene. A back sheet may desirably be hinged to the opposite edge of the one sheet.

The invention will now be described with reference to the accompanying drawings, wherein.

Figure 4:
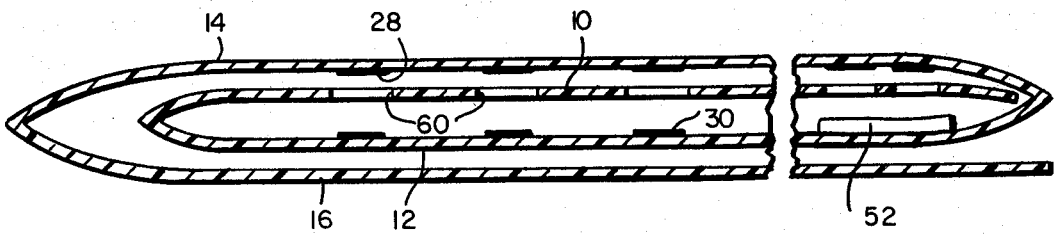
FIG. 4 is a diagrammatic section through the folded structure.

Referring to the drawings, the display cover device 10 includes four panels 10, 12, 14 and 16 of flexible sheet material, e.g. polyester (Mylar®), polyethylene, etc., hingedly connected at their adjacent edges by suitable hinge means 18, 20 and 22, and forming a report cover, i.e. a cover into which a report such as a company annual report may be placed. When folded, as shown in FIG. 4, the panel 16 is situated at the bottom, the panel 12 situated immediately above the panel 16 and parallel thereto, the panel 10 is situated above the panel 12 and parallel thereto and the panel 14 is at the top above the panel 10 and parallel thereto, and a report, not shown, would be placed between panel 12 and panel 16 and stapled to the fold area between panels 14 and 16.

The panel 14 has on it a printed circuit 24 and the panel 12 a corresponding printed circuit 26, each circuit comprising a plurality of contact areas 28 and 30 which pair up when the sheets 12 and 14 are folded into confronting relation. Between the contact areas 28 and the contact areas 30, there are conductors 32 and 34. A conductor 36 connects one of the contacts of the array of the contacts on the sheet 12 to a terminal 38 on the sheet 14 and a conductor 38 connects one of the array of contacts on the sheet 14 with a terminal 42 on the sheet 14. The terminals 38 and 42 comprise a pair of terminals.

Figure 5:
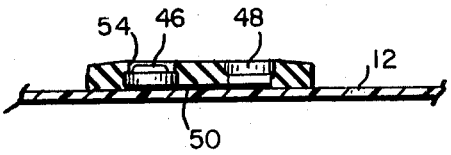
FIG. 5 is a section through the cell means.

Cell means 44 are fastened to the panel 12 comprising two cells 46 and 48 mounted to the panel 12 with their opposed poles connected by a printed conductor 50, FIG. 5, and in a position and at a spacing such that when the panels are folded, the opposite poles will engage the terminals 38, 42, thus placing the cells in the circuit as a source of electric power. The cells are mounted in a block of cushion-like material 52 which frictionally receive and hold the cells within holes 54 in the block.

Figure 1:
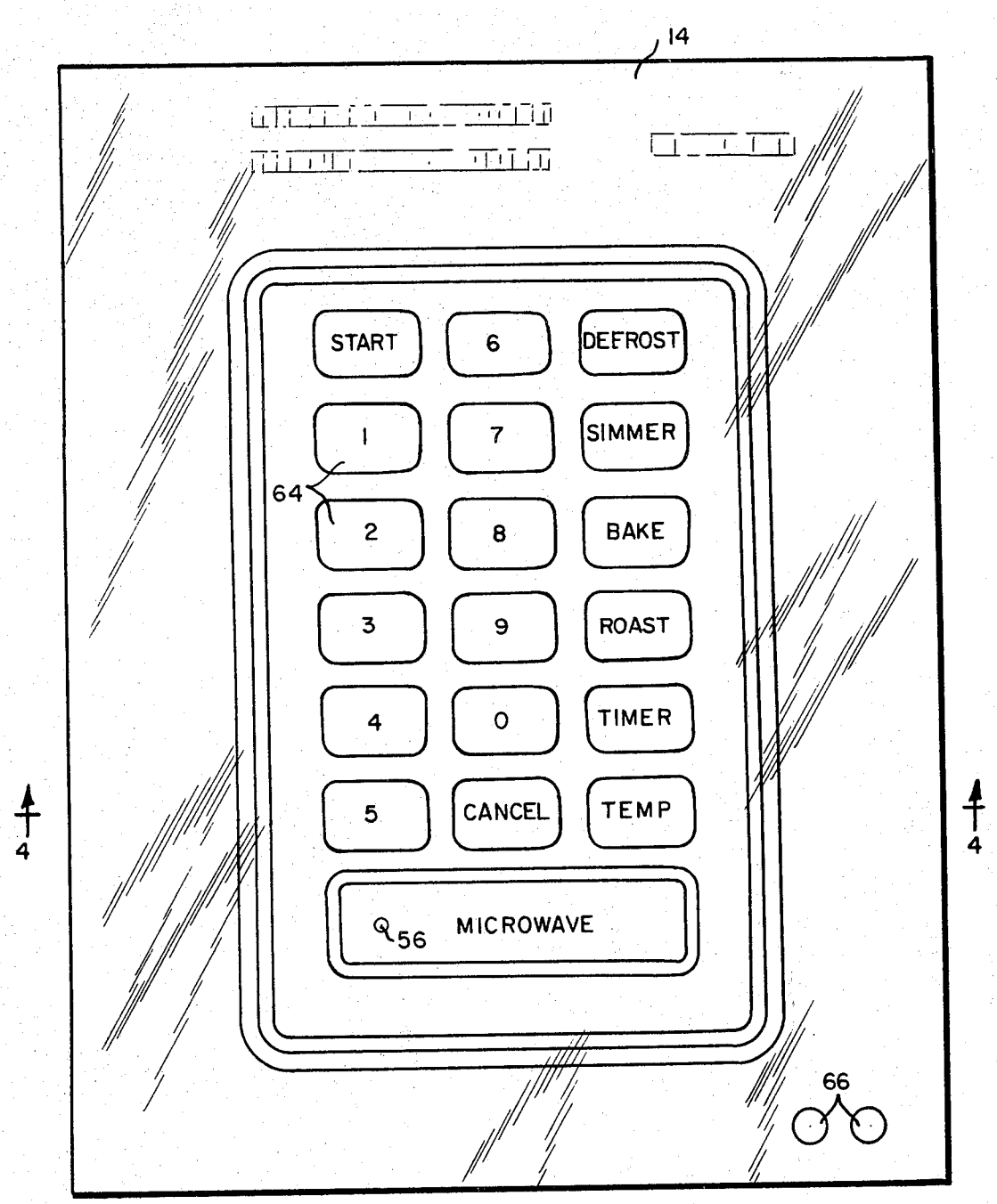
FIG. 1 is a plan view of the front side of the display device.
Figure 2:
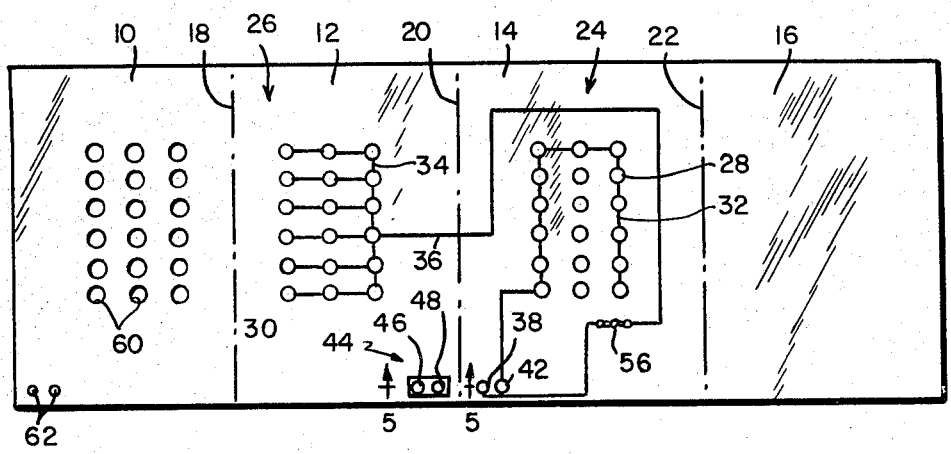
FIG. 2 is a plan view of the display device with its component parts disposed in a common plane.
Figure 3:
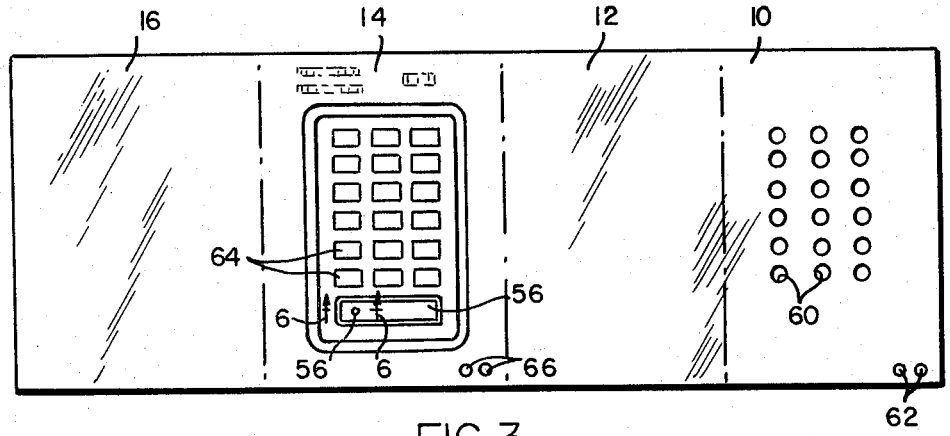
FIG. 3 is a plan view of the opposite side of the display device.
Figure 6:
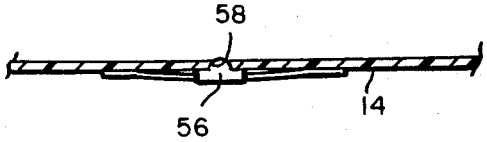
FIG. 6 is a section through the diode.

A display indicator such as an LED (Diode) 56, or other conventional indicator device, e.g. LC (liquid crystal) or light bulb, is mounted to the panel 14 in the conductor 36 in a position overlying a hole 58 in the panel so that a portion of the diode protrudes from the opposite side of the panel at the face side as shown in FIGS. 1, 3 and 6.

The panel 10 is a sheet of polyethylene, polyester, etc. or similar material which is non-conductive and contains holes 60 arranged in the same pattern as the arrangement of the contact areas on the panels 12 and 14 and holes 62 corresponding in location and spacing to the poles and terminals. When the structure is folded, the non-conductive panel lies between the contact areas on the sheet 12 and the contact areas on the sheet 14 and between the poles on the sheet 12 and the terminals on the sheet 14. The non-conductive sheet is designed to maintain the contact areas and the poles and terminals separated from each other in non-conductive relation.

On the outer side of the panel 14, there are indicia 66, arranged in a pattern corresponding to the arrangement of the contact areas on the inner side of this panel and of the position of the cells at the inner side of the panel. By pressing on the areas 66 indicating the position of the cells so as to bring the poles together and then pressing a selected one of the designated areas, a circuit can be established through a predetermined portion of the circuitry to light up the indicator. The indicia (graphics) 64 are desirably designed to imitate a keyboard and bear legends appropriate to the purpose the device is intended to demonstrate. The conductive patterns may be formed of electrically conductive ink screened on in the usual manner, or etched on. See U.S. Pat. Nos. 3,860,771, 3,383,487 and 4,066,851.

It should be understood that the present disclosure is for the purpose of illustration only and includes all modifications or improvements which fall within the scope of the appended claims.

While no search has been made on this disclosure, reference should be had to U.S. Pat. No. 3,860,771, 3,383,487, 4,066,851, United Kingdom Pat. No. 1,426,119, and the art cited therein for background.

We claim:

1. A cover with display device comprising hinged sheets defining the leaves of a cover designed to receive, for example, a company report, a printed circuit on each of the two interfacing surfaces of two adjacent sheets embodying contact areas on the respective sheets which can be brought into engagement by pressing the sheets together in the areas of the contacts, tabulated indicia on the outer surface of one of the sheets corresponding in position to the contacts on the inner side thereof for indicating the position of the contacts between the sheets, said indicia representing the current flow in the printed circuit completed by pressing any predetermined pair of contacts together and said indicia being imitative of a keyboard and bearing legends, a pair of terminals on the inner side of said one of the sheets, a pair of cells at the inner side of the other sheet disposed with their opposed poles at one end connected and with their opposed poles at the other end positioned to engage the pair of terminals on the said one of the sheets when the sheets are folded into confronting relations, a yieldable sponge rubber cushion block attached to the inner side of said other of the sheets containing spaced holes for frictionally receiving and holding the pair of cells so positioned, said block being thicker than the cells so that the poles of the cells confronting said one of the sheets are held spaced from the terminals until pressure is applied to compress the block sufficiently to expose the poles at the ends of the cells, means on the outer surface of said one sheet indicating the location of the cells and the contact areas at the inner side to enable pressing the poles of the cells into engagement with the terminals to supply the circuit with energy, said one of the sheets containing a hole located in the area of the tabulated indicia, a diode attached to the inner side of said one of said sheets in a position to protrude said hole, means connected the diode in the circuitry so as to be energized by completion of current flow in the circuitry, a non-conductive barrier sheet comprised of flexible plastic hingedly connected to one edge of said one of the sheets interposable between the sheets, said barrier sheet containing openings corresponding in position to the positions of the contacts and the cells through which the contact areas and poles of the cells can be engaged by pressing upon the indicia and said means on the outer side of one of the sheets to engage the contact areas and poles on the inner sides of the sheets and a backing sheet hingedly connected to the other edge of said one of the sheets for folding over the said other of the sheets and the barrier sheet positioned between the sheets.

* * * * *

UNITED STATES PATENT AND TRADEMARK OFFICE

CERTIFICATE OF CORRECTION

PATENT NO. : 4,251,734

DATED : February 17, 1981

INVENTOR(S) : Carl P. Mayer, Robert A. Rothenberg

It is certified that error appears in the above-identified patent and that said Letters Patent are hereby corrected as shown below:

Column 4, Claim 1, line 5, after "protrude" insert ---through---

Signed and Sealed this

*Sixteenth* Day of *June 1981*

[SEAL]

*Attest:*

RENE D. TEGTMEYER

*Attesting Officer*

*Acting Commissioner of Patents and Trademarks*